United States Patent [19]

Johne et al.

[11] 4,454,812

[45] Jun. 19, 1984

[54] SAFETY DEVICE FOR COUNTER ROLLERS IN A PRINTING MACHINE

[75] Inventors: Hans Johne; Lothar Schmidt, both of Radebeul; Arndt Jentzsch, Coswig, all of German Democratic Rep.

[73] Assignee: Veb Kombinat Polygraph "Werner Lamberz" Leipzig, Leipzig, German Democratic Rep.

[21] Appl. No.: 424,956

[22] Filed: Sep. 27, 1982

[30] Foreign Application Priority Data

Nov. 6, 1981 [DD] German Democratic Rep. ... 234663

[51] Int. Cl.[3] ..... B41F 33/14

[52] U.S. Cl. ..... 101/212; 101/216; 100/53; 68/264

[58] Field of Search ..... 101/212, 216, 219; 100/53; 68/264

[56] References Cited

U.S. PATENT DOCUMENTS

| | | | |
|---|---|---|---|
| 2,734,370 | 2/1956 | Cleiff | 68/264 |
| 3,498,217 | 3/1970 | Kletti | 101/216 |
| 3,577,918 | 11/1971 | Wayfield | 101/375 |
| 3,698,527 | 10/1972 | Wiggers | 100/53 |
| 3,808,970 | 5/1974 | Delligatti | 101/375 |
| 4,056,829 | 11/1977 | Ikeda | 101/415.1 |
| 4,278,827 | 7/1981 | Johne et al. | 101/212 |
| 4,295,421 | 10/1981 | Abendroth et al. | 101/216 |
| 4,307,798 | 12/1981 | Watanabe | 100/53 |

FOREIGN PATENT DOCUMENTS 86022 5/1973 German Democratic Rep. .

*Primary Examiner*—William Pieprz
*Attorney, Agent, or Firm*—Michael J. Striker

[57] ABSTRACT

A printing press is provided with a safety device mounted in the vicinity of a gap formed between two counter printing rollers for preventing the gap from intrusion by foreign elements, such as a mop or the hand of an operator. The device includes a four-link transmission unit operatively interconnected between pivotable guard plates and a cam switch adapted to actuate an end switch of the printing press to shut the latter off. The guard plates are swung away from the rollers so that the gap is enlarged.

4 Claims, 4 Drawing Figures

SAFETY DEVICE FOR COUNTER ROLLERS IN A PRINTING MACHINE

BACKGROUND OF THE INVENTION

The present invention pertains to printing machines in general. More particularly, the invention relates to a safety device for preventing entering of a foreign element into a contact gap between counter rollers of a printing machine.

Safety devices for printing machines of the type under consideration are known in the art. One of such devices is disclosed in the patent DD-PS No. 86022. The device described in the above patent is arranged in the vicinity of the contact gap between the printing rollers and includes a radially movable control shaft rotationally-rigidly connected to two guard plates and provided with a cam segment. The cam segment cooperates with a plunger of the control switch. The control shaft is held in its operation position by a spring-loaded rod.

Each guard plate is subdivided into two portions so that the outer portion of the plate faces the printing rollers whereas the inner portion thereof is pivotally supported and spring-loaded on a hinge.

If a foreign element enters the contact gap in the region of the printing rollers this foreign element presses against the guard plate. The safety arrangement upon that pressure turns and actuates the control switch through the cam element and shuts down the printing machine. Before the machine is finally stopped, the foreign element, for example a hand of an operator, must be pulled out. The outer portion of the guard plate will rotate against the force of the spring and will free a required space to enable one to pull the foreign element out of the gap.

The disadvantage of this otherwise satisfactory device is that when the guard plate is swung away from the printing roller the gap between the outer portion of the guard plate and the roller is still narrow. Although the required sufficiently large gap can be obtained by twisting or turning of the outer portion of the guard plate this will result in considerable high energy consumption during pulling out of the foreign element from the gap.

The outer portions of the guard plates in the known device should be locked in the open position when the printing machine is at standstill in order to enable an operator to make certain auxiliary operations, for example to replace the rubber blanket or to clamp the printing plate. A potential danger in this is that, after all the auxiliary operations have been completed the safety device is not closed, this causing an additional source of danger when the machine is put into operation. Furthermore, there is a possibility that during the above mentioned auxiliary operations a second person can switch on the main switch.

A further disadvantage of the known safety device is that its components, particularly the hinges of the guard plates, are subject to contamination.

SUMMARY OF THE INVENTION

It is an object of the present invention to provide an improved safety device for counter rollers of a printing machine.

It is a further object of the invention to minimize energy consumption required for pulling out a foreign element away from the contact gap between the rollers.

It is still another object of the invention to exclude the conditions at which putting the printing machine into operation takes place with the open guard plates.

It is another object of the invention to reduce the possibility of contaminating the safety device.

Still another object of the invention is to provide an improved safety device in which the guard plates are capable of swinging away from the rollers such that the gap between the edges of the plates and the cylinders is significantly increased.

These and other objects of the invention are attained by a safety device mounted in the vicinity of a contact gap formed between two counter printing rollers of the printing press, which device comprises two pivotable guard plates extending along the length of said rollers and connected to each other; a four-link transmission unit arranged in two planes within side walls of the printing press; a cam element; and an end switch for switching on and off the printing press and actuated by said cam element; said four-link transmission unit being operatively interconnected between said cam element and said guard plates and including four links, two links of said unit being connected to each other by a coupling member and pivotally supporting the respective guard plates which are radially spring-loaded on said two links, respectively, said coupling member being provided with two stops each assigned to the respective guard plate whereby if a foreign element comes into contact with at least one of said guard plates the latter press against the respective stops so that said unit causes pivoting of the guard plates away from said rollers and actuates said end switch via said cam element to switch the printing press off.

The slide elements may be provided on a frame of the printing press, the guide plates being pivotable towards the printing rollers and away from the latter and being provided with stop elements which are adapted to engage the respective slide elements to limit the pivoting movement of said guard plates away from said rollers.

A third link of the four-link transmission unit may be formed by a pin supported in the side walls of the printing press.

A forth link of the four-link transmission unit may be supported at two sides thereof on a shaft extending through the whole width of the printing press.

Each of the guard plates may be curved at the edge thereof facing the rollers and in the direction towards the contact gap.

Each of the aforementioned two links may be formed by a support shaft, each support shaft carrying a first cam member rigidly connected to the support shaft and a second cam member slidably positioned on the support shaft and adapted to engage said first cam member upon rotation of the support shaft, said second cam member being rigidly connected to the assigned guard plate and being spring-loaded.

The advantage of the safety device according to the invention resides in that, due to enlarging of the gap in the vicinity of the printing rollers, energy consumption required for pulling out a foreign element from that gap is significantly minimized. Furthermore, opening or pivoting the guard plates away from the rollers provides for an additional free space in the vicinity of the rollers.

A further advantage of the safety device of the invention is that the upper links of the four-link transmission unit are not formed as through shafts and the through shaft extends only through the lower link of that unit whereby an operator can easily observe that sufficient free space in the vicinity of the rollers since the sight is not obstructed by the through shaft.

The guard plates are in their open position at a standstill of the printing press such that a free space is always available to an operator for auxiliary or preparatory operations. During the opening of the guard plates the end switch is actuated and the printing press can be set up to start again only when the guard plates are returned into their operation position.

Still a further advantage of the invention is that starting the printing machine by a second person when the guard plates are in inoperative position is impossible.

Due to the fact that the conventional two-portion guard plates and the hinges utilized for their pivoting are not used in the present invention the possibility of contamination of the components of the device is substantially minimized.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
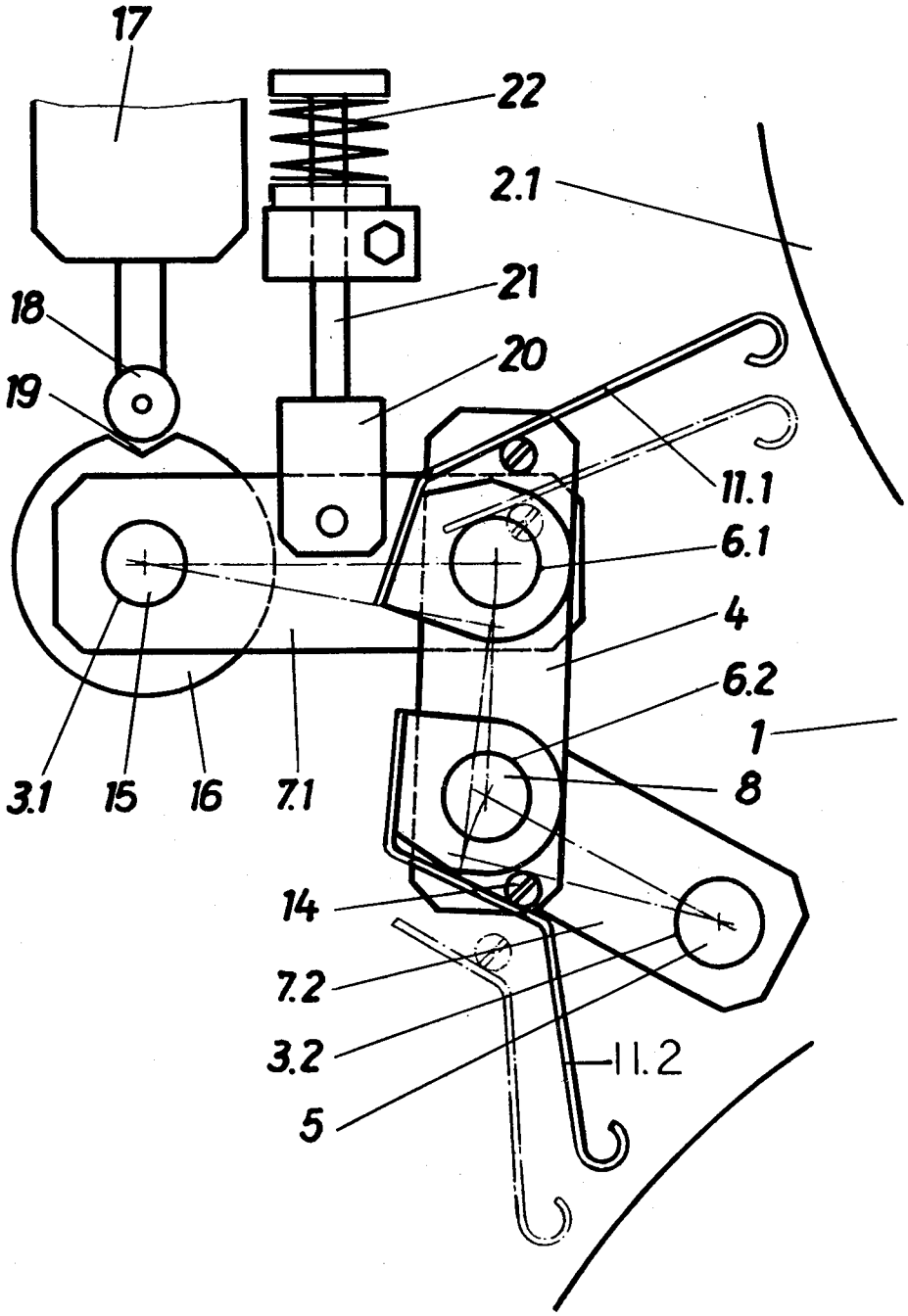
FIG. 1 is a schematic view of a safety device according to the invention.

Referring now to the drawings, and first to FIG. 1, reference character 1 denotes a contact gap between two counterrunning printing rollers or cylinders 2.1 and 2.2. The safety device according to the invention is arranged in that gap and extends in principle in two planes between side walls of the printing machine not illustrated herein and known per se.

Figure 2:
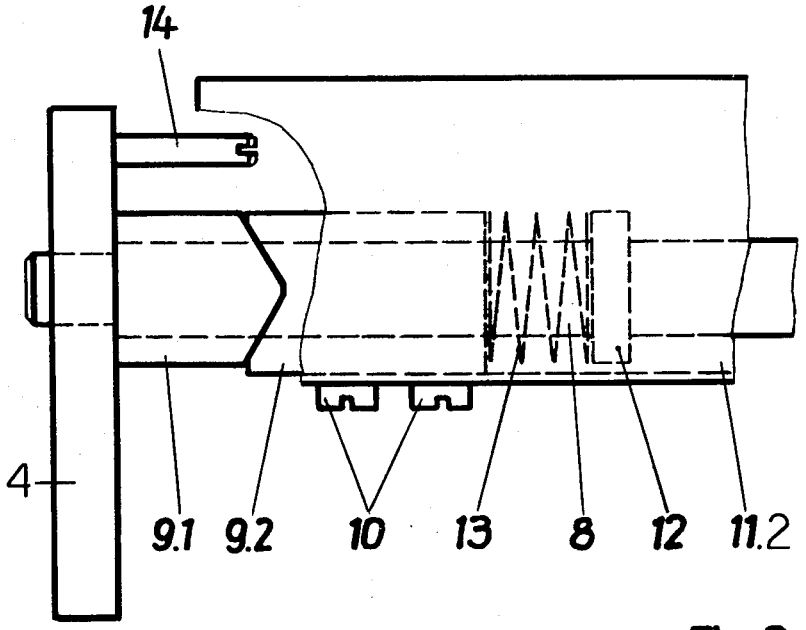
FIG. 2 is a schematic view of an individual link of a transmission arrangement of the safety device of FIG. 1, in an operative position of the guard plate.

The safety device in accordance with the invention includes a four-link transmission unit. This unit includes two links 3.1 and 3.2, and two links 6.1 and 6.2 each associated with a respective guard plate 11.1 and 11.2 and coupled to each other with a coupling element 4. The lower link 3.2 is formed by a through shaft 5 which extends through the entire width of the printing machine and is supported at two opposite ends thereof at the side walls of the printing machine or press not shown in the drawing. The link 6.2 associated with the lower guard plate 11.2 connects the coupling element 4 with a lower transmission member 7.2 mounted on the shaft 5. Link 6.2 is arranged on a support shaft 8 which is shown in FIG. 2 in detail. Rigidly mounted on the shaft 8 is a first cam element 9.1. A second cam element 9.2 arranged in engagement with the first cam element is movable on the support shaft 8. Second cam element 9.2 is rigidly connected to the guard plate 11.2 by means of screws 10. A collar 12 is rigidly mounted on the support shaft 8. A prestressed helical spring 13 is positioned between the second cam element 9.2 and collar 12.

The guard plate 11.2 at its side facing toward the associated cylinder 2.2 can bear against a stop screw 14 of the coupling member 4. The outer edge of the guard plate 11.2 at its side facing toward cylinder 2.2 is curved towards gap 1.

It is to be noted that the arrangement on the link 6.1 corresponds to the above described arrangement for the link 6.2. The shape of the upper guard plate 11.1 is similar to that of plate 11.2.

The link 3.1 is defined by a pin 15 supported in the side walls of the printing machine. Mounting link 3.1 is connected to the coupling element 4 by an upper transmission member 7.1. A cam segment or curved plate 16 is rotationally fixed to the upper transmission member 7.1. The cam segment is formed with a groove 19 adapted to engage an end surface of a plunger 18 of an end switch 17. The cam segment or curved plate 16 is coupled with the end switch 17 by means of the plunger 18 and groove 19 when the printing machine is in its operative position, and also when the the safety device with the guard plates is not in its deflected position.

As the upper transmission member 7.1 are pivotally mounted spring rods 21 connected to the member 7.1 by connecting elements 20 and supported at the machine frame.

Compression springs 22 are provided on the spring rods 21, springs 22 being so prestressed that the safety device is held in the operation condition. The forces of the springs are precalculated so that even small pressure applied to the safety device will cause swinging the guard plates away from the gap 1.

Figure 4:
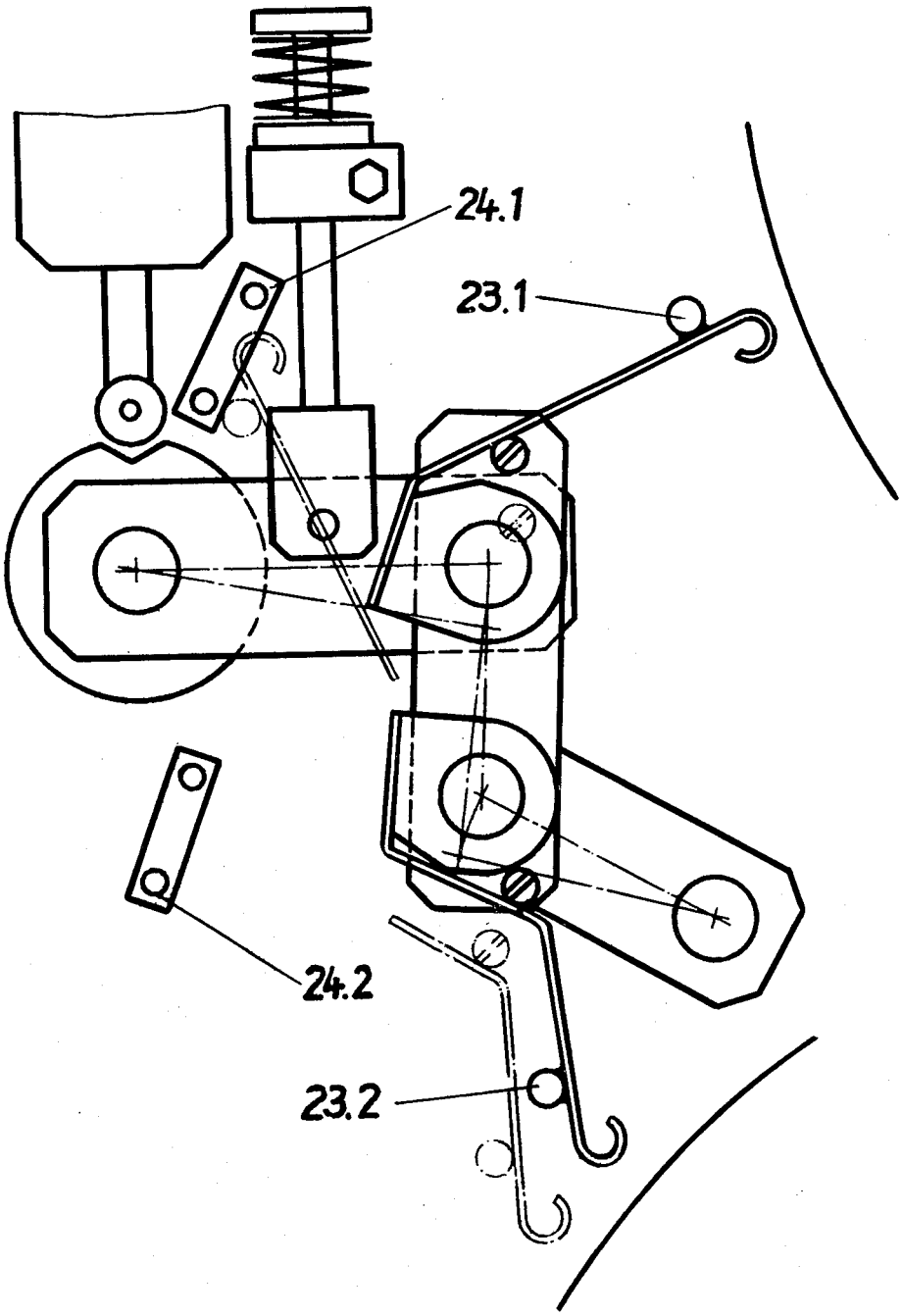
FIG. 4 is a schematic view similar to FIG. 1 but showing one guard plate in its fully lifted position.

The guard plates 11.1 and 11.2 are further provided with stop elements 23.1 and 23.2, respectively seen in FIG. 4. These stop elements are connected to the outer sides of the guard plates and are adapted to cooperate with respective limiting members 24.1 and 24.2 mounted on the frame of the printing machine. When the guard plates are swung away from the gap 1 the stop elements 23.1 and 23.2 press against the respective limiting members whereby the swinging movement of the guard plates is limited.

The operation of the safety device is as follows:

If a foreign element for example an operator's hand or a mop comes into contact with any of two guard plates 11.1, 11.2 during operation, this guard plate under pressure of that foreign element presses against the respective stop screw 14 provided on the coupling member 4. A coupling point formed between coupling element 4 and transmission member 7, which point extends through the link 6 will then describe a circular arc or curve about the link 3 and the guard plate will move away from cylinders 2.1 and 2.2.

Due to the linkage between the first cam element 9.1 and the second cam element 9.2 the guard plate held in its position is pivoted and performs with its end inclined to the cylinders 2.1, 2.2 a curved-like movement which causes an additional displacement thereof away from the printing cylinders.

The position of the upper transmission member 7.1 coupled to element 4 is also changed; this transmission member pivots and thus turns the cam segment 16 connected therewith. The end of the plunger 18 will be thereby pushed out of the groove 19 and the end switch 17 will be actuated. The printing machine will be switched off thereby.

Figure 3:
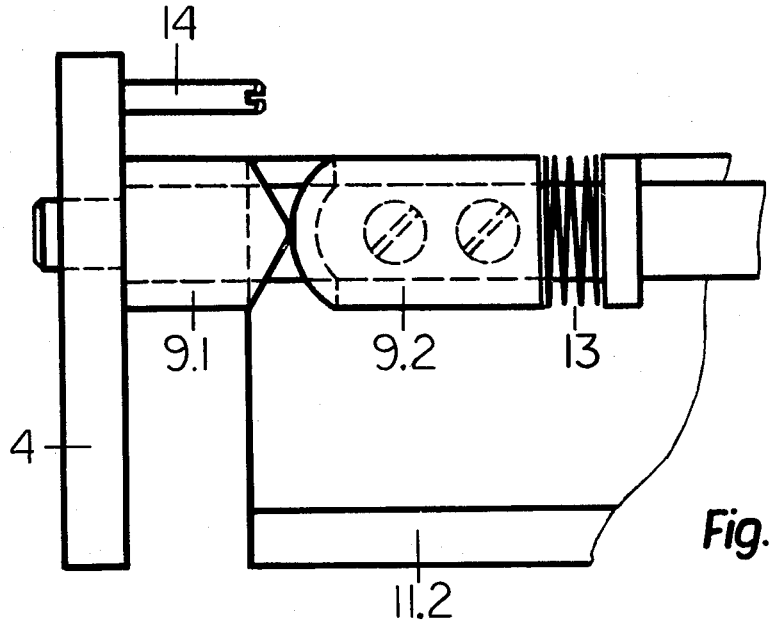
FIG. 3 is a schematic view of the individual link of the transmission arrangement but with the guard plate in its lifted position.

Each guard plate can itself pivot about link 6 in each position of the safety device. Each guard plate can be thus moved away from the contact gap 1. As seen in FIG. 3 when the guard plate is pivoted the second cam element 9.2 is rotated against the first cam element 9.1. The cam pair and the second cam element will thus act against the compressed helical spring 13.

If the guard plate is pivoted at 90° with respect to its position shown in FIG. 2 the helical spring 13 will lock both cam elements 9.1 and 9.2 so that the guard plate will reach the stable position (see FIG. 4). In this position the guard plate will press with its stop 23 against the respective slide element 24.1 or 24.2. In the position as shown in FIG. 4 the safety device is pivoted away from the cylinders and the end switch 17 is actuated.

It will be understood that each of the elements described above, or two or more together, may also find a useful application in other types of safety devices for counter rollers differing from the types described above.

While the invention has been illustrated and described as embodied in a safety device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a printing press, in which counter printing rollers are arranged to form a contact gap therebetween, a safety device mounted in the vicinity of the contact gap to prevent foreign element from entering thereinto and comprising two pivotable guard plates extending along the length of said rollers and connected to each other; a transmission unit including four links arranged within side walls of the printing press; a coupling member connecting a first link and a second link of said unit to each other, a first transmission member interconnected between said first link and a third link of said unit, and a second transmission member inter-connected between said second link and a fourth link of said unit, said fourth link being a shaft extending through the whole width of the printing press and rotatably mounted within the press side walls; a cam segment, said third link carrying said cam segment; and 9 cam segment actuated switch for switching the printing press on and off and actuated by said cam segment; said transmission unit being connected to said cam segment and said guard plates, two links of said being connected to each other by a coupling member and said first link and said second link supporting the respective guard plates, said plates being spring-loaded on said first link and said second link, respectively, said coupling member being provided with two stops each assigned to the respective guard plate whereby if a foreign element comes into contact with at least one of said guard plates the latter press against the respective stops so that said unit causes pivoting of the guard plates away from said rollers and actuates said switch via said cam segment to switch the printing press off.

2. The safety device as defined in claim 1, wherein limiting elements are provided on a frame of the printing press, said guard plates being pivotable to and from said rollers and being provided with additional stop elements attached thereto, said stop elements adapted to engage the respective limiting elements to limit the pivoting movement of said guard plates away from said rollers.

3. The safety device as defined in claim 1, wherein each of said guard plates is curved at the edge thereof facing said rollers and in the direction toward said gap.

4. The safety device as defined in claim 1, wherein each of said first and second links is formed by a support shaft, each support shaft carrying a first cam member rigidly connected to the support shaft and a second cam member slidably positioned on the support shaft and adapted to engage said first cam member upon rotation of the support shaft, said second cam member being rigidly connected to the assigned guard plate and being spring-loaded.

* * * * *